US010355389B2

(12) United States Patent
Reedy et al.

(10) Patent No.: US 10,355,389 B2
(45) Date of Patent: Jul. 16, 2019

(54) HIGH-CURRENT ELECTRICAL TERMINAL

(71) Applicant: Delphi Technologies, LLC, Troy, MI (US)

(72) Inventors: Patrick Joseph Reedy, Youngstown, OH (US); Michael L. Mellott, Youngstown, OH (US); Steven William Marzo, Cortland, OH (US); Glenn E. Robison, Youngstown, OH (US); Hoi Lui, Warren, OH (US)

(73) Assignee: DELPHI TECHNOLOGIES, LLC, Troy, MI (US)

( * ) Notice: Subject to any disclaimer, the term of this patent is extended or adjusted under 35 U.S.C. 154(b) by 0 days.

(21) Appl. No.: 15/891,892

(22) Filed: Feb. 8, 2018

(65) Prior Publication Data

US 2019/0044271 A1 Feb. 7, 2019

Related U.S. Application Data

(60) Provisional application No. 62/539,656, filed on Aug. 1, 2017.

(51) Int. Cl.

| | |
|---|---|
| ***H01R 24/76*** | (2011.01) |
| ***H01R 13/44*** | (2006.01) |
| ***H01R 24/28*** | (2011.01) |
| ***H01R 13/11*** | (2006.01) |
| ***H01R 13/26*** | (2006.01) |
| ***H01R 13/115*** | (2006.01) |
| ***H01R 13/04*** | (2006.01) |
| ***H01R 13/20*** | (2006.01) |

(Continued)

(52) U.S. Cl.

CPC ..... *H01R 13/44* (2013.01); *H01R 13/04* (2013.01); *H01R 13/113* (2013.01); *H01R 13/115* (2013.01); *H01R 13/20* (2013.01); *H01R 13/26* (2013.01); *H01R 24/28* (2013.01); *H01R 24/66* (2013.01); *H01R 4/185* (2013.01); *H01R 43/16* (2013.01); *H01R 2101/00* (2013.01); *H01R 2201/26* (2013.01)

(58) Field of Classification Search

CPC ..... H01R 24/76; H01R 24/00; H01R 24/60; H01R 24/62; H01R 33/76; H01R 13/453

USPC ..... 439/682, 708, 660

See application file for complete search history.

(56) References Cited

U.S. PATENT DOCUMENTS 6,945,826 B2 9/2005 Wise
8,298,022 B2 10/2012 Tsuruta et al.
(Continued)

*Primary Examiner* — Hien D Vu
(74) *Attorney, Agent, or Firm* — Joseph Victor Bonadies

(57) ABSTRACT

An electrical-terminal includes a planar blade-shaped isolator and a conductor. The planar blade-shaped isolator is formed of a dielectric material having a spine, a tip, and a web. The spine extends along a longitudinal-axis. The tip extends along a lateral-axis, and the web extends from the spine and terminates at the tip. The web defines a slot extending in the lateral direction from and normal to the spine. The conductor has a first-side that overlays a second-side and defines a U-shaped bend and a gap between the first-side and the second side. The U-shaped bend is aligned parallel to and opposite the spine. The conductor includes a conductive stand-off located intermediate the first side and the second side of the conductor. The conductive stand-off is disposed within the slot of the web such that the first-side and the second-side are in further electrical contact through the conductive stand-off.

8 Claims, 11 Drawing Sheets

(51) Int. Cl.

| | |
|---|---|
| ***H01R 24/66*** | (2011.01) |
| *H01R 4/18* | (2006.01) |
| *H01R 43/16* | (2006.01) |
| *H01R 101/00* | (2006.01) |

(56) References Cited

U.S. PATENT DOCUMENTS

| | | | | |
|---|---|---|---|---|
| 9,004,928 | B2 * | 4/2015 | Tanaka | B60L 3/0069 439/86 |
| 9,004,954 | B2 | 4/2015 | Baldwin et al. | |
| 9,608,357 | B1 * | 3/2017 | Sundarakrishnamachari | H01R 13/4534 |
| 9,647,372 | B2 | 5/2017 | Eckel | |
| 9,787,020 | B2 * | 10/2017 | Choi | H01R 13/53 |
| 2004/0115980 | A1 | 6/2004 | Douty et al. | |
| 2012/0009828 | A1 | 1/2012 | Yagi et al. | |
| 2016/0064849 | A1 | 3/2016 | Eckel | |
| 2017/0025787 | A1 | 1/2017 | Choi et al. | |
| 2017/0170594 | A1 | 6/2017 | Copper et al. | |

* cited by examiner

HIGH-CURRENT ELECTRICAL TERMINAL

CROSS-REFERENCE TO RELATED APPLICATION

This application claims the benefit under 35 U.S.C. § 119(e) of U.S. Provisional Patent Application No. 62/539,656, filed Aug. 1, 2017, the entire disclosure of which is hereby incorporated herein by reference.

TECHNICAL FIELD OF INVENTION

This disclosure generally relates to an electrical connector, and more particularly relates to an electrical connector that is capable of transferring electrical current in excess of 200 Amperes.

BACKGROUND OF INVENTION

It is known to use electrical connectors capable of transferring electrical current in excess of 100 Amperes (100 A) in electric vehicles (EVs) and hybrid-electric vehicles (HEVs). As non-EVs and non-HEVs become increasingly electrified to reduce greenhouse gasses, electrical connectors require increasingly robust, reliable, and safe designs. Increasing the electrical current carrying capacity of these connector designs is typically accomplished by increasing the geometric dimensions of the electrical conductors. A safety issue arises when the size of the electrical connector is increased to a point where a human finger can contact the electrical conductors due to the clearances designed into the electrical connectors.

U.S. Pat. No. 6,945,826 B2 issued to Wise discloses a plug with a pair of electrical pin contacts (male terminals) in which each has a central metal contact portion surrounded on three exterior sides by insulative protection members aligned with the length of the metal portion. The alignment of the protective insulating exterior sides with the metal portion allows the terminals to be plugged into a socket with the normal plug inserting action, without interference, while providing protection against a human finger bridging the two terminals during insertion, or later in the case of an incomplete insertion.

U.S. Pat. No. 8,298,022 B2 issued to Tsuruta, et al, discloses an electrical connector having an electrical pin contact or terminal similar to that in Wise, though insulated only on the tip, in which the terminal is also surrounded by an aligned protective wall member longer than the terminal. The spacing of wall from terminal is intended to prevent the insertion of a human fingertip far enough to contact the metal, conductive, part of the terminal.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF DESCRIPTION OF DRAWINGS

The present invention will now be described, by way of example with reference to the accompanying drawings, in which.

The reference numbers of similar elements in the embodiments shown in the various figures share the last two digits.

DETAILED DESCRIPTION

An electrical terminal capable of carrying currents in excess of 200 Amperes, and in some cases in excess of 400 Amperes (400 A), is presented herein. This invention uses a planar shaped electrical conductor with a protective isolator that prevents a human finger from contacting the conductor when used in an electrical connector.

Figure 1B:
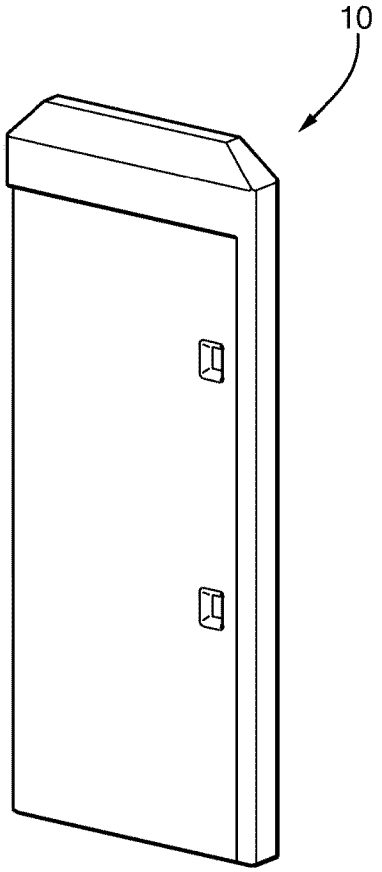
FIG. 1B is an illustration of the high-current electrical-terminal of FIG. 1A in an assembled state in accordance with one embodiment.
Figure 1A:
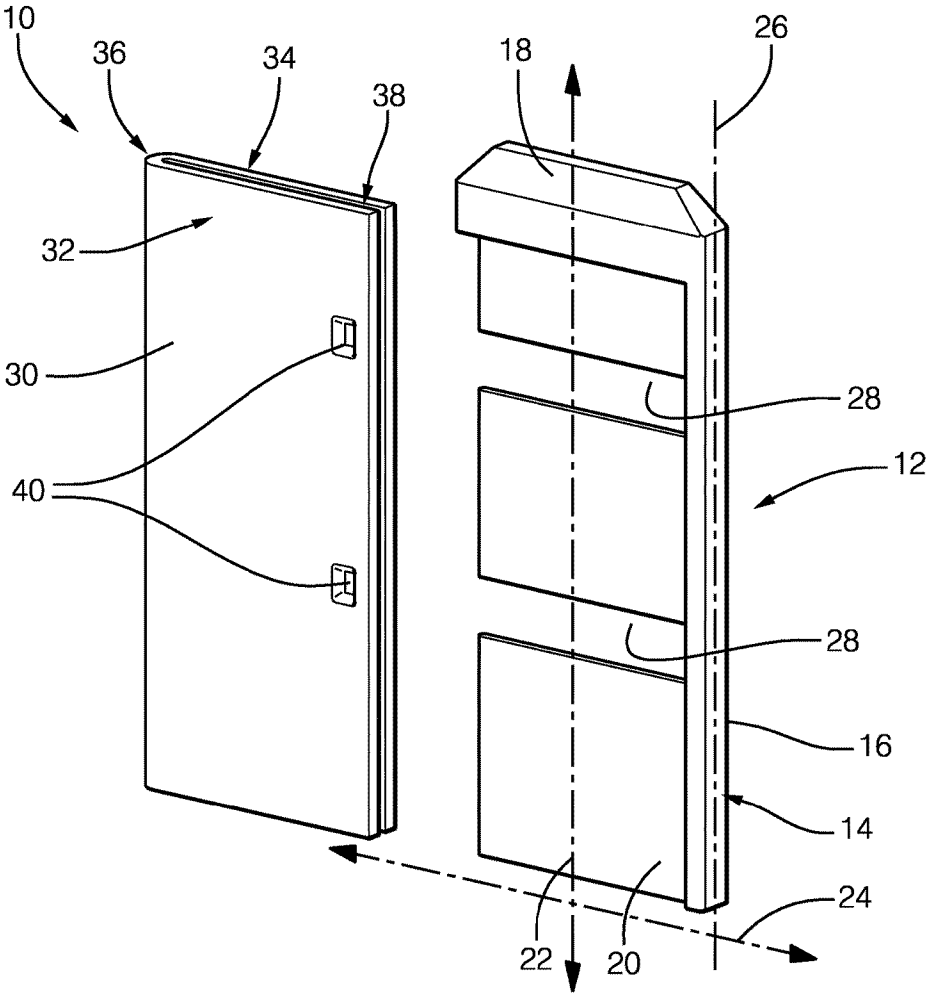
FIG. 1A is an illustration of an exploded view of a high-current electrical-terminal in accordance with one embodiment.

FIGS. 1A-1B illustrate a first example of a high-current electrical-terminal 10. FIG. 1A is an exploded view of the electrical-terminal 10 to illustrate the features that would not be visible in the assembled state illustrated in FIG. 1B. The electrical-terminal 10 includes a planar blade-shaped isolator 12 formed of a dielectric material 14. The dielectric material 14 may be any dielectric material 14 capable of electrically isolating portions of the electrical-terminal 10, and is preferably a polyamide (NYLON) material. The planar blade-shaped isolator 12 has a spine 16, a tip 18, and a web 20. The spine 16 extends along a longitudinal-axis 22 of the electrical-terminal 10. The tip 18 extends along a lateral-axis 24 normal to the spine 16, and the web 20 extends in a lateral direction from and normal to a mid-line 26 of the spine 16 along the longitudinal-axis 22 and terminates at the tip 18. The web 20 defines a slot 28 extending in the lateral direction from and normal to the spine 16. Preferably, a thickness of the web 20 is at least one millimeter (1 mm).

The electrical-terminal 10 also includes a conductor 30 formed of a single piece of electrically conductive-material. The electrically conductive-material may be any electrically conductive-material and is preferably formed of a copper-based alloy. Preferably, a stock thickness of the electrically conductive-material is at least 2 mm. This provides the technical benefit of enabling the electrical-terminal 10 to conduct electrical currents in excess of 400 A. The conductor 30 may also be coated with a conductive-coating, such as tin, silver, or gold, thereby providing the benefit of improving surface conductivity and/or providing protection against corrosion.

The conductor 30 has a first-side 32 that overlays a second-side 34 and defines a U-shaped bend 36 and a gap 38 between the first-side 32 and the second-side 34. The gap 38 is configured to receive the web 20, as will be described in more detail below. The U-shaped bend 36 is aligned parallel to and opposite the spine 16. The conductor 30 includes a conductive stand-off 40 located intermediate the first-side 32 and the second-side 34 of the conductor 30. The conductive stand-off 40 is disposed within the slot 28 of the web 20 such that the first-side 32 and the second-side 34 are in further electrical contact through the conductive stand-off 40. As illustrated in FIG. 1A, the web 20 may define a plurality of slots 28 extending in the lateral direction from and normal to the spine 16, and the conductor 30 may include a plurality of conductive stand-offs 40 located intermediate the first-side 32 and the second-side 34. The conductive stand-off 40 provides the technical benefit of resisting creep (i.e. deformation) of the conductor 30 due to a normal-force exerted by a mating-terminal (not shown) at elevated operating temperatures characteristic of high current applications. A quantity and position of the conductive stand-off 40 may be determined by the material properties of the conductor 30 and a dimension of the conductor 30.

Figure 2:
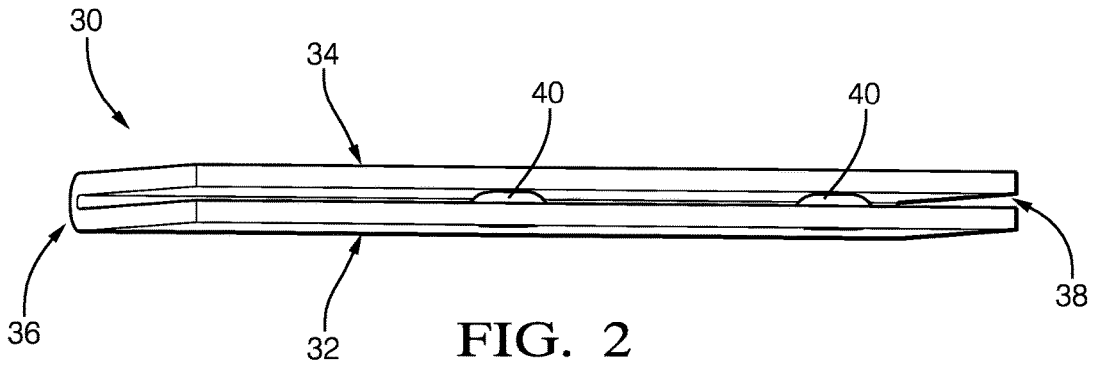
FIG. 2 is an illustration of a conductor from the electrical-terminal of FIG. 1A in accordance with one embodiment.

FIG. 2 illustrates a perspective-view of the conductor 30 removed from the electrical-terminal 10 of FIGS. 1A-1B. The plurality of conductive stand-offs 40 may be integrally formed (e.g. formed by an embossing process) in the conductor 30 and may be positioned proximate to edges of the conductor 30. Alternatively, the plurality of conductive stand-offs 40 may also be integrally formed in both the first-side 32 and the second-side 34 of the conductor 30.

Figure 3:
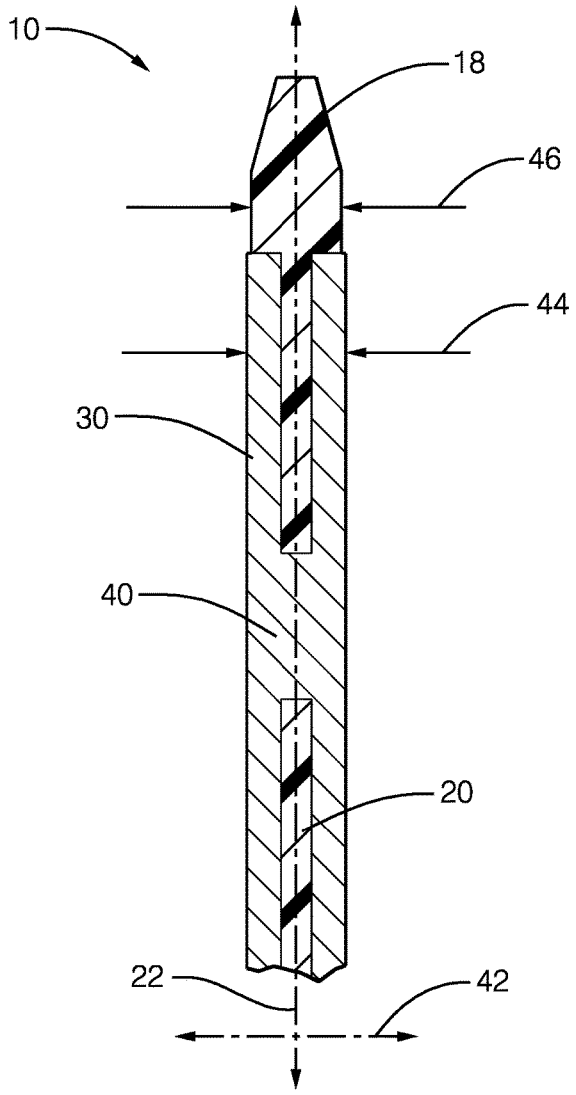
FIG. 3 is an illustration of a cross-section of the electrical-terminal of FIG. 1B in accordance with one embodiment.

FIG. 3 illustrates a cross-section view of the electrical-terminal 10 along a transverse-axis 42 orthogonal to both the longitudinal-axis 22 and the lateral-axis 24. A width of the conductor 44 along the transverse-axis 42 is greater than a width of the tip 46 of the planar blade-shaped isolator 12. The narrower width of the tip 46 provides the technical benefit of inhibiting the material of the tip 18 from being displaced and forming a non-conductive deposit on the first-side 32 and second-side 34 of the conductor 30 when the mating-terminal from a mating-connector (not shown) engages the electrical-terminal 10 and slides along the longitudinal-axis 22 that could potentially reduce the surface conductivity of the electrical-terminal 10.

Figure 4:
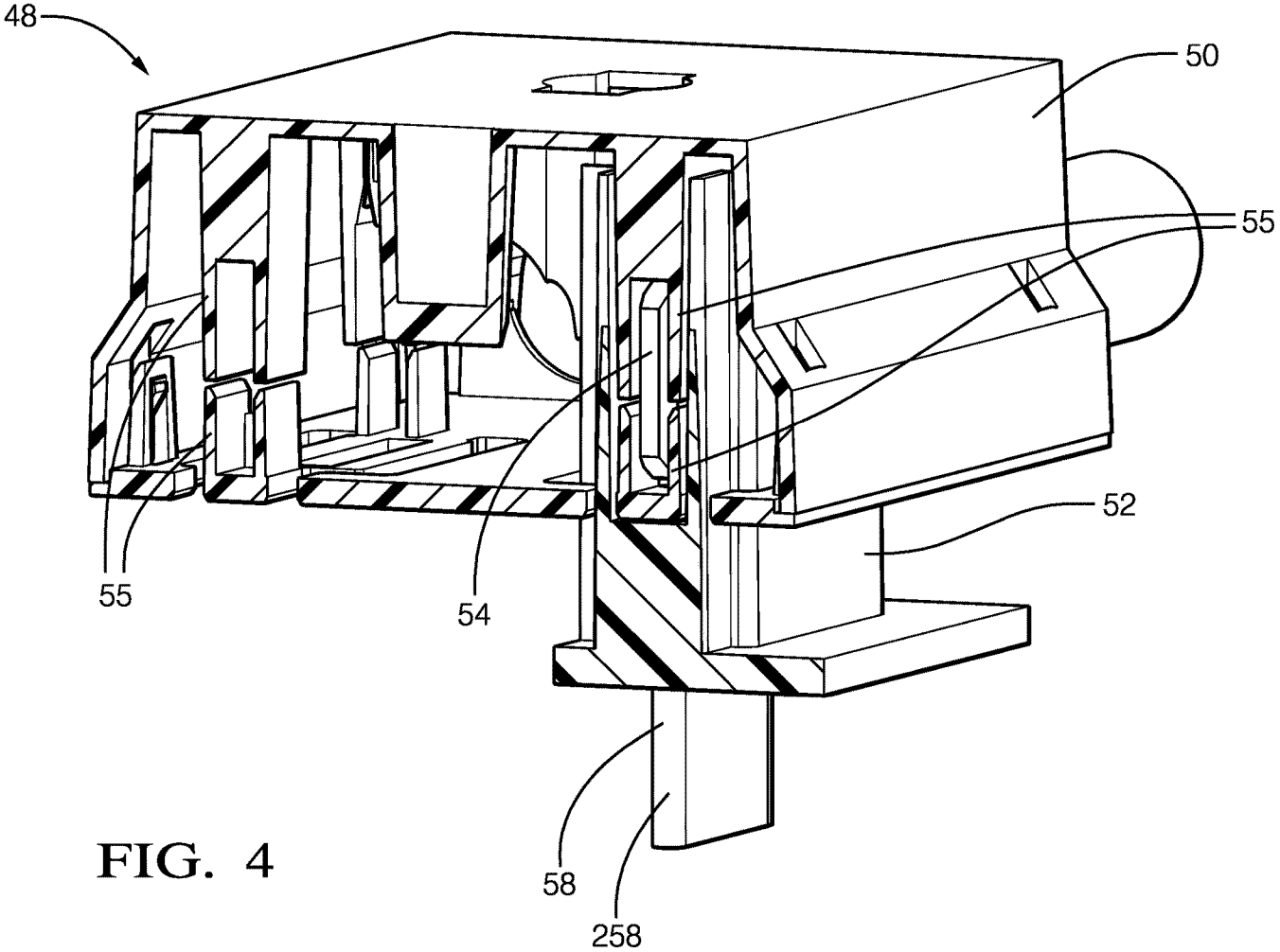
FIG. 4 is an illustration of an electrical connector in accordance with another embodiment.

FIG. 4 illustrates another example of an electrical connector 48 that includes a first-housing 50 and a second-housing 52 mated with the first-housing 50. The first-housing 50 has a first-electrical-terminal 54 surrounded by stabilizer-walls 55 projecting from an upper-half and a lower-half of the first-housing 50. The electrical connector 48 illustrated in FIG. 4 is a two-way electrical connector 48, but is shown with only one connection for illustrative purposes. The first-housing 50 and the second-housing 52 may be formed of a polymeric material with dielectric properties, such as a polyamide material.

Figure 5:
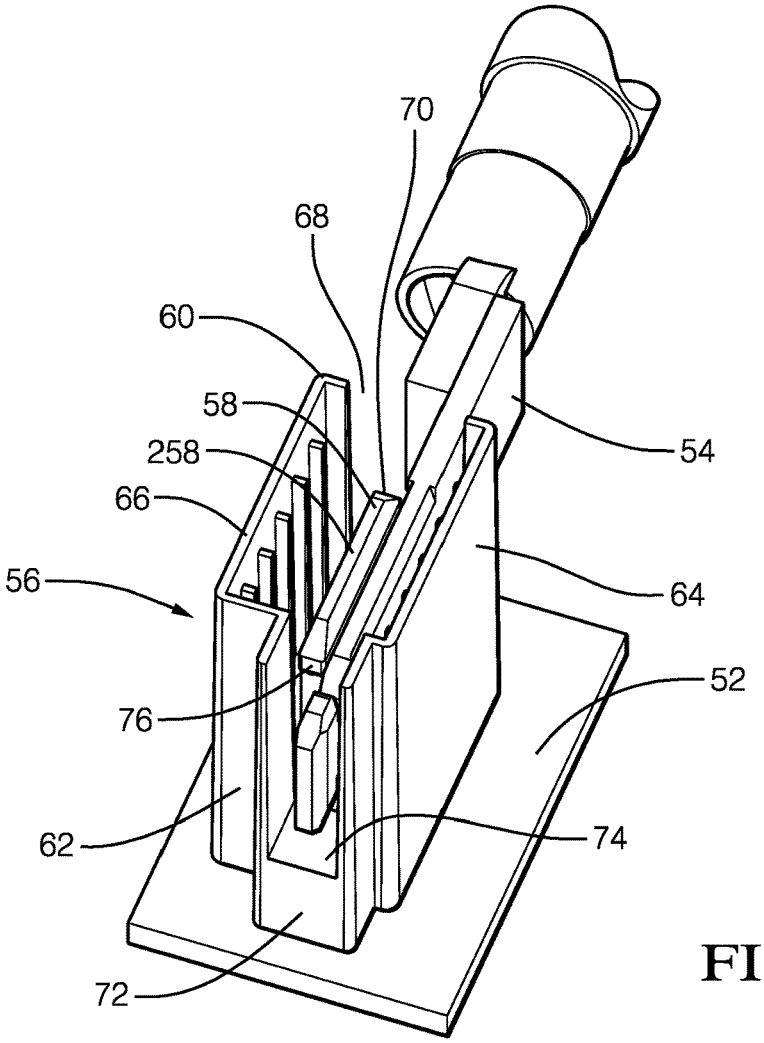
FIG. 5 is an illustration of a second-housing and a first-electrical-terminal of the electrical connector of FIG. 4 in accordance with another embodiment.

FIG. 5 illustrates the first-electrical-terminal 54 and the second-housing 52 isolated from the electrical connector 48 of FIG. 4. The second-housing 52 includes a protective-shroud 56 and a second-electrical-terminal 58 disposed within the protective-shroud 56. The protective-shroud 56 has a front-side 60, a back-side 62 aligned parallel to the front-side 60, a first-wall 64 aligned orthogonal to both the front-side 60 and the back-side 62, and a second-wall 66 aligned parallel to the first-wall 64. The front-side 60 defines a first-opening 68 that exposes a leading-edge 70 of the second-electrical-terminal 58, and the back-side 62 includes an extension 72 aligned perpendicular to the back-side 62. The extension 72 defines a second-opening 74 that exposes a portion of a trailing-edge 76 of the second-electrical-terminal 58.

Figure 6:
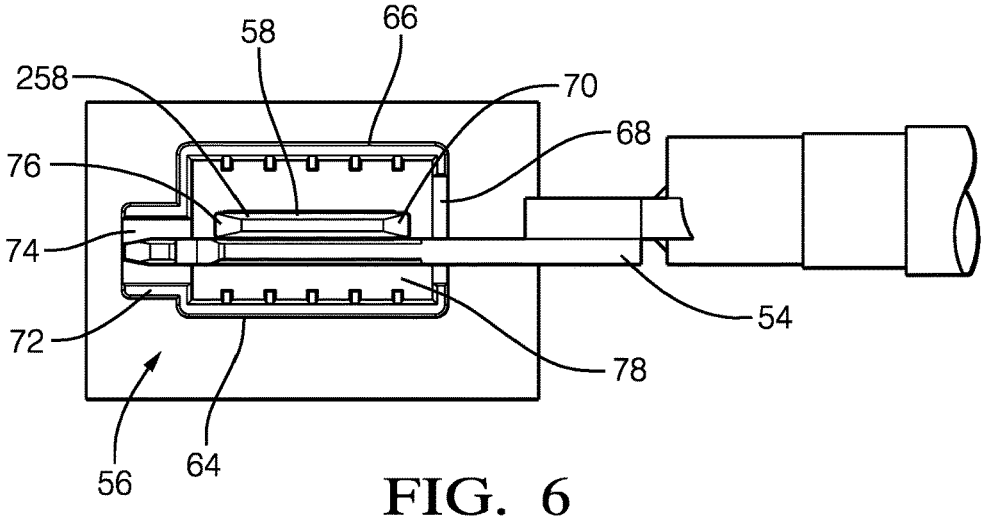
FIG. 6 is an illustration of a top-view of the second-housing and the first-electrical-terminal of the electrical connector of FIG. 5 in accordance with another embodiment.

FIG. 6 is a top-view of the first-electrical-terminal 54 and the second-housing 52 shown in FIG. 5. The protective-shroud 56 defines a terminal-slot 78 extending from the second-opening 74 to the first-opening 68 and is bounded by the first-wall 64 and the second-electrical-terminal 58. The terminal-slot 78 is configured to receive the first-electrical-terminal 54. When first-housing 50 is mated with the second-housing 52, the first-electrical-terminal 54 is disposed within the terminal-slot 78 in electrical and physical contact with the second-electrical-terminal 58, and the first-wall 64 and the extension 72 stabilize the first-electrical-terminal 54. The first-electrical-terminal 54 may be held in contact with the second-electrical-terminal 58 by a retainer clip (not shown), or other attachment methods, contained within the first-housing 50.

Figure 7A:
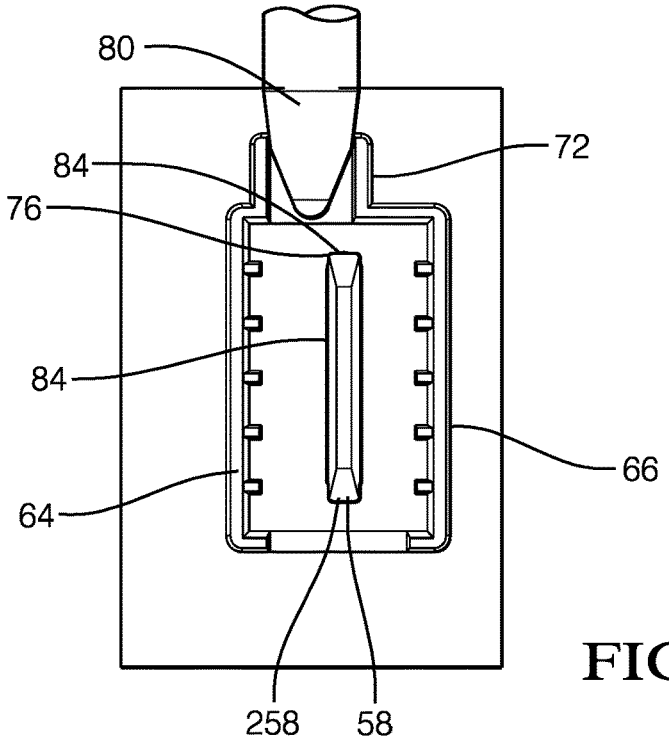
FIG. 7A is an illustration of the top-view of the second-housing with a standard probe inserted in accordance with another embodiment.
Figure 7B:
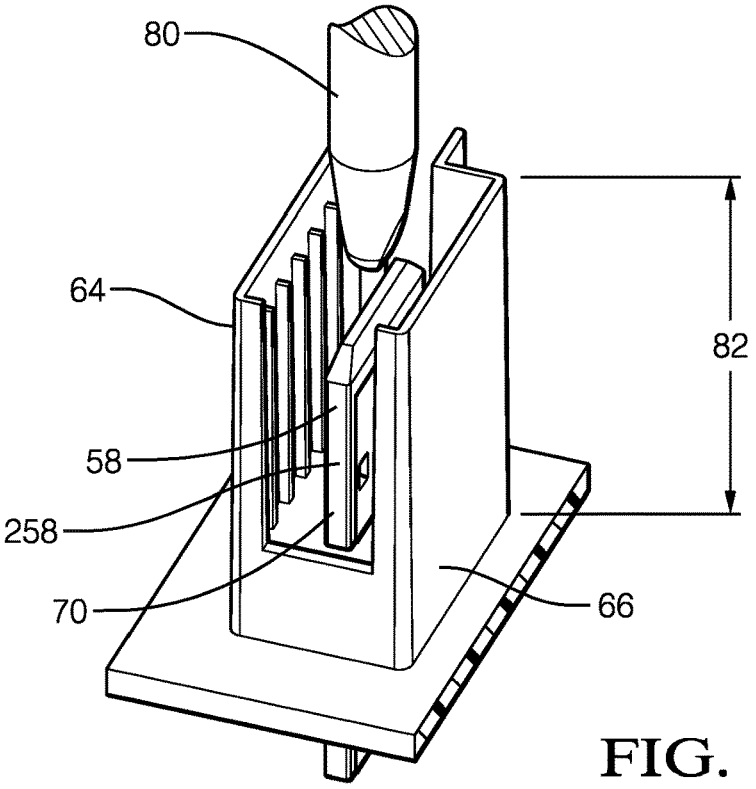
FIG. 7B is an illustration of a perspective-view of the second-housing with the standard probe inserted in accordance with another embodiment.

FIGS. 7A-7B illustrate the second-housing 52 isolated from the first-electrical-terminal 54 of FIGS. 5-6. The extension 72 provides the technical benefit of inhibiting a standard probe 80 configured to simulate a human finger, as defined by the International Standard IEC 60529, *Degrees of Protection Provided by Enclosures*, from contacting the trailing-edge 76 of the second-electrical-terminal 58 when the electrical connector 48 is in an un-mated condition, as illustrated in FIG. 7A. In addition, a height 82 of both the first-wall 64 and the second-wall 66, along with electrical isolation features of the second-electrical-terminal 58, further provides the technical benefit of inhibiting the standard probe 80 from contacting a conductive-surface 84 of the second-electrical-terminal 58 as illustrated in FIG. 7B.

Figure 8B:
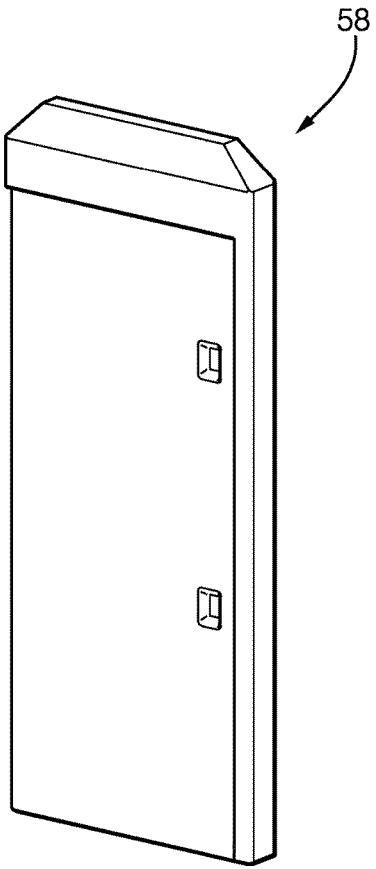
FIG. 8B is an illustration of the second-electrical-terminal of FIG. 8A in an assembled state in accordance with another embodiment.
Figure 8A:
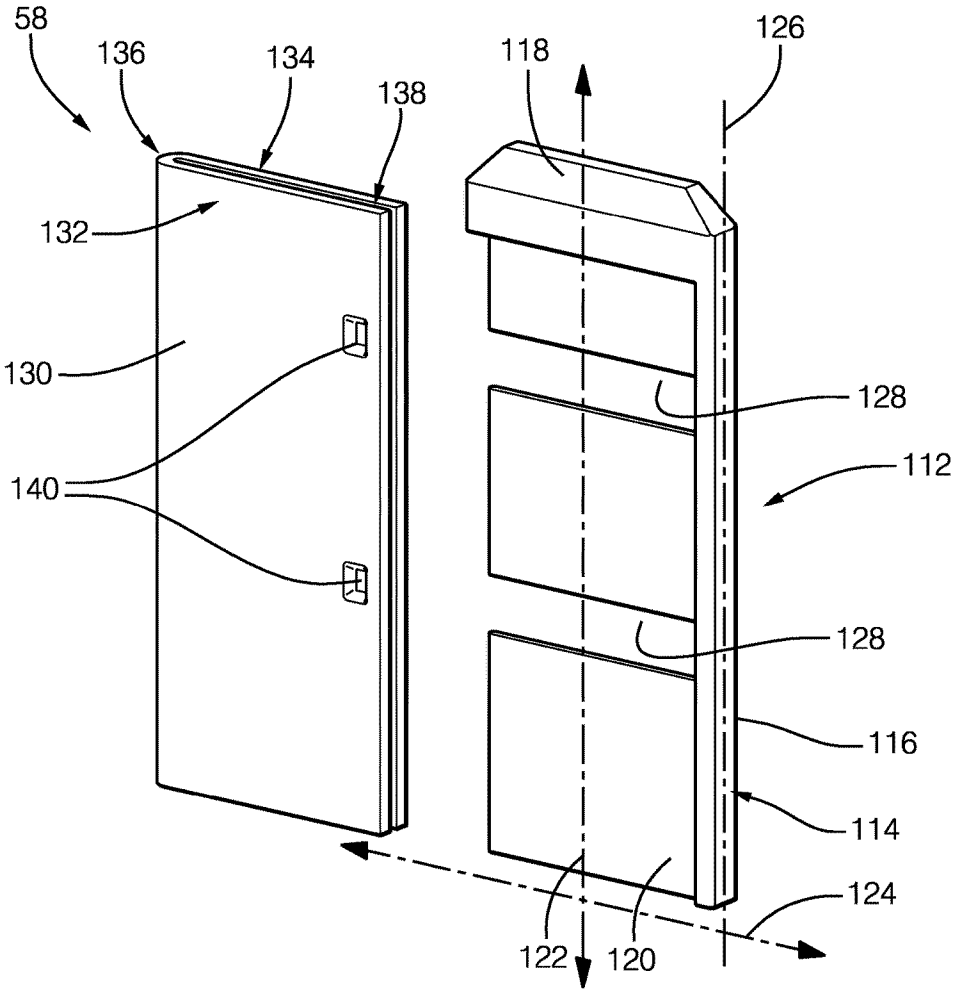
FIG. 8A is an illustration of an exploded view of a second-electrical-terminal from the electrical connector of FIG. 4 in accordance with another embodiment.

FIGS. 8A-8B illustrate the second-electrical-terminal 58 isolated from the second-housing 52 of FIG. 5. The second-electrical-terminal 58 includes a planar blade-shaped isolator 112 formed of a dielectric material 114. The dielectric material 114 may be any dielectric material 114 capable of electrically isolating portions of the second-electrical-terminal 58, and is preferably a polyamide material. The planar blade-shaped isolator 112 has a spine 116, a tip 118, and a web 120. The spine 116 extends along a longitudinal-axis 122 of the second-electrical-terminal 58. The tip 118 extends along a lateral-axis 124 normal to the spine 116, and the web 120 extends in a lateral direction from and normal to a mid-line 126 of the spine 116 along the longitudinal-axis 122 and terminates at the tip 118. The web 120 defines a slot 128 extending in the lateral direction from and normal to the spine 116. Preferably, a thickness of the web 120 is at least one millimeter (1 mm).

The second-electrical-terminal 58 also includes a conductor 130 formed of a single piece of electrically conductive-material. The electrically conductive-material may be any electrically conductive-material and is preferably formed of a copper-based alloy. Preferably, a stock thickness of the electrically conductive-material is at least 2 mm. This provides the technical benefit of enabling the second-electrical-terminal 58 to conduct electrical currents in excess of 400 A. The conductor 130 may also be coated with a conductive-coating, such as tin, silver, or gold, thereby providing the benefit of improving surface conductivity and/or providing protection against corrosion.

The conductor 130 has a first-side 132 that overlays a second-side 134 and defines a U-shaped bend 136 and a gap 138 between the first-side 132 and the second side 134. The gap 138 is configured to receive the web 120, as will be described in more detail below. The U-shaped bend 136 is aligned parallel to and opposite the spine 116. The conductor 130 includes a conductive stand-off 140 located intermediate the first-side 132 and the second-side 134 of the conductor 130. The conductive stand-off 140 is disposed within the slot 128 of the web 120 such that the first-side 132 and the second-side 134 are in further electrical contact through the conductive stand-off 140. As illustrated in FIG. 8A, the web 120 may define a plurality of slots 128 extending in the lateral direction from and normal to the spine 116, and the conductor 130 may include a plurality of conductive stand-offs 140 located intermediate the first-side 132 and the second-side 134. The conductive stand-off 140 provides the technical benefit of resisting creep (i.e. deformation) of the conductor 130 due to a normal-force exerted by the first-electrical-terminal 54 at elevated operating temperatures characteristic of high current applications. A quantity and position of the conductive stand-off 140 may be determined by the material properties of the conductor 130 and a dimension of the conductor 130.

Figure 9:
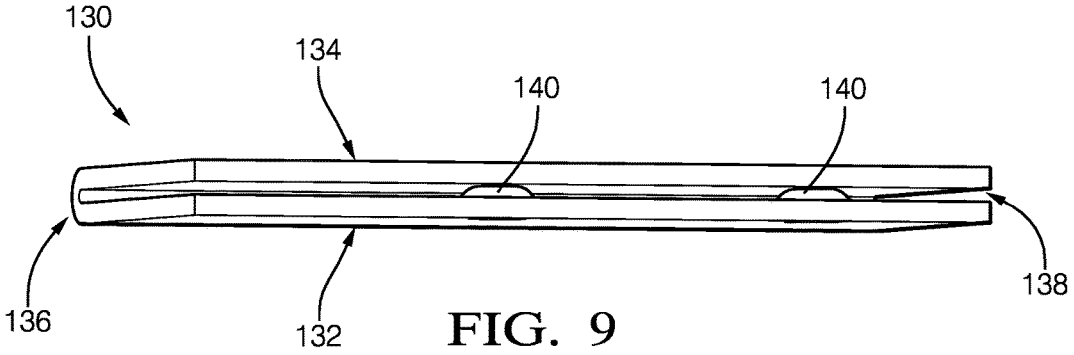
FIG. 9 is an illustration of a conductor from the second-electrical-terminal of FIG. 8A in accordance with another embodiment.

FIG. 9 illustrates a perspective-view of the conductor 130 removed from the second-electrical-terminal 58. The plurality of conductive stand-offs 140 may be integrally formed (e.g. an embossing process) in the conductor 130 and may be positioned proximate to edges of the conductor 130. The plurality of conductive stand-offs 140 may also be integrally formed in both the first-side 132 and the second-side 134 of the conductor 130.

Figure 10:
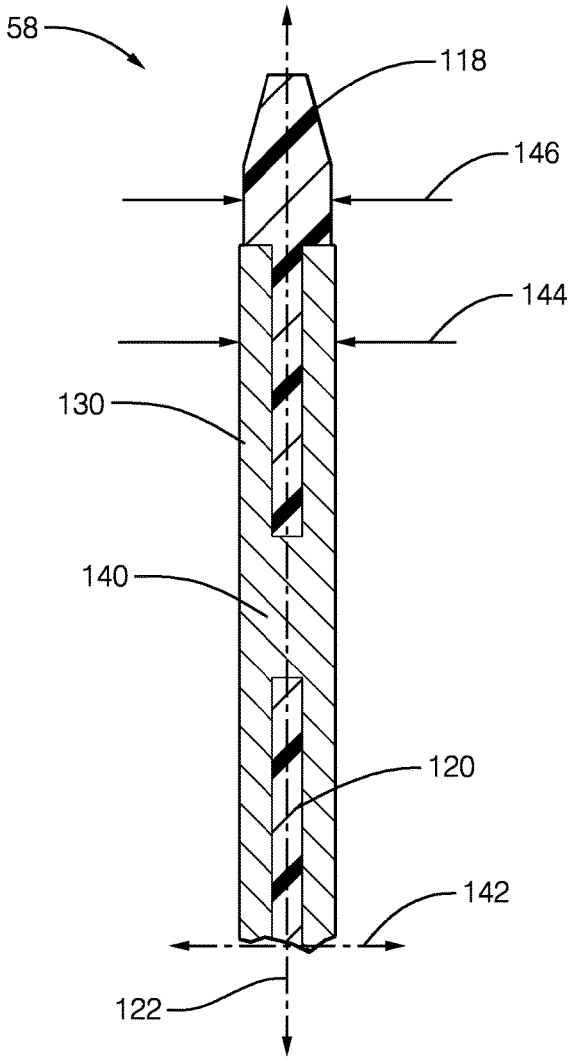
FIG. 10 is an illustration of a cross-section of the second-electrical-terminal of FIG. 8B in accordance with another embodiment.

FIG. 10 illustrates a cross-section view of the second-electrical-terminal 58 along a transverse-axis 142 orthogonal to both the longitudinal-axis 122 and the lateral-axis 124. A width of the conductor 144 along the transverse-axis 142 is greater than a width of the tip 146 of the planar blade-shaped isolator 112. The narrower width of the tip 146 provides the technical benefit of inhibiting the material of the tip 118 from being displaced and forming a non-conductive deposit on the first-side 132 and second-side 134 of the conductor 130 when the first-electrical-terminal 54 from the first-housing 50 engages the second-electrical-terminal 58 and slides along the longitudinal-axis 122 that could potentially reduce the surface conductivity of the second-electrical-terminal 58.

Figure 11B:
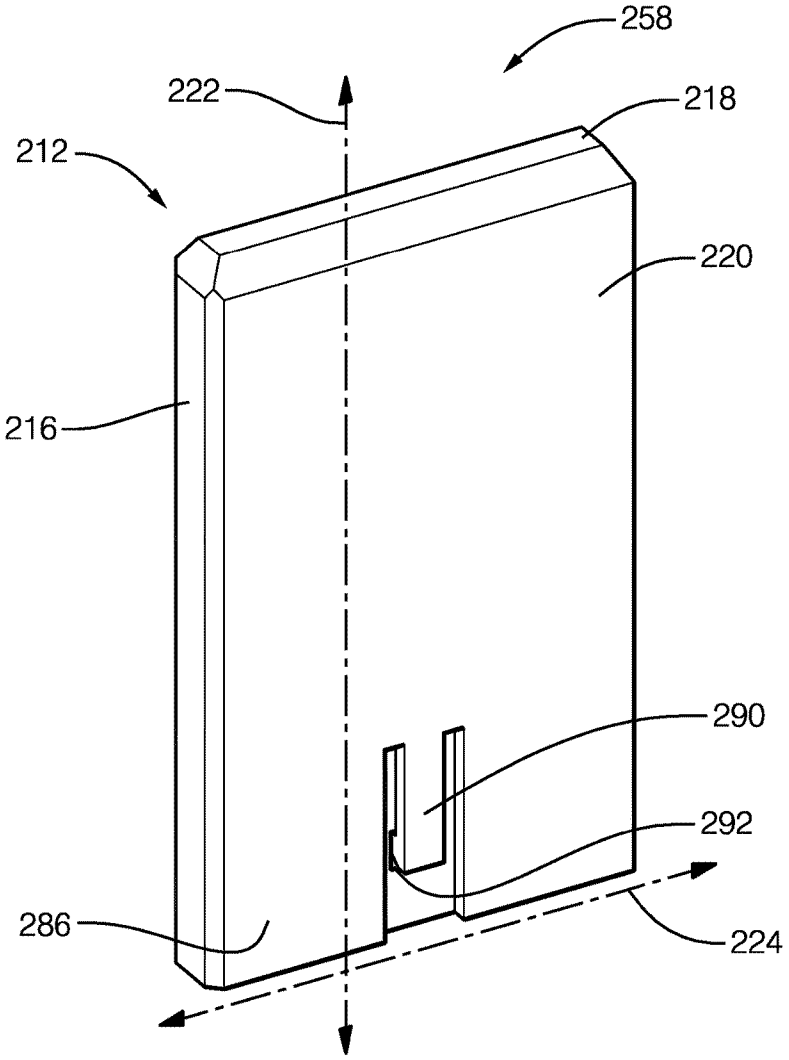
FIG. 11B is a perspective-view of another side of the alternative second-electrical-terminal from the connector of FIG. 4 in accordance with yet another embodiment.
Figure 11A:
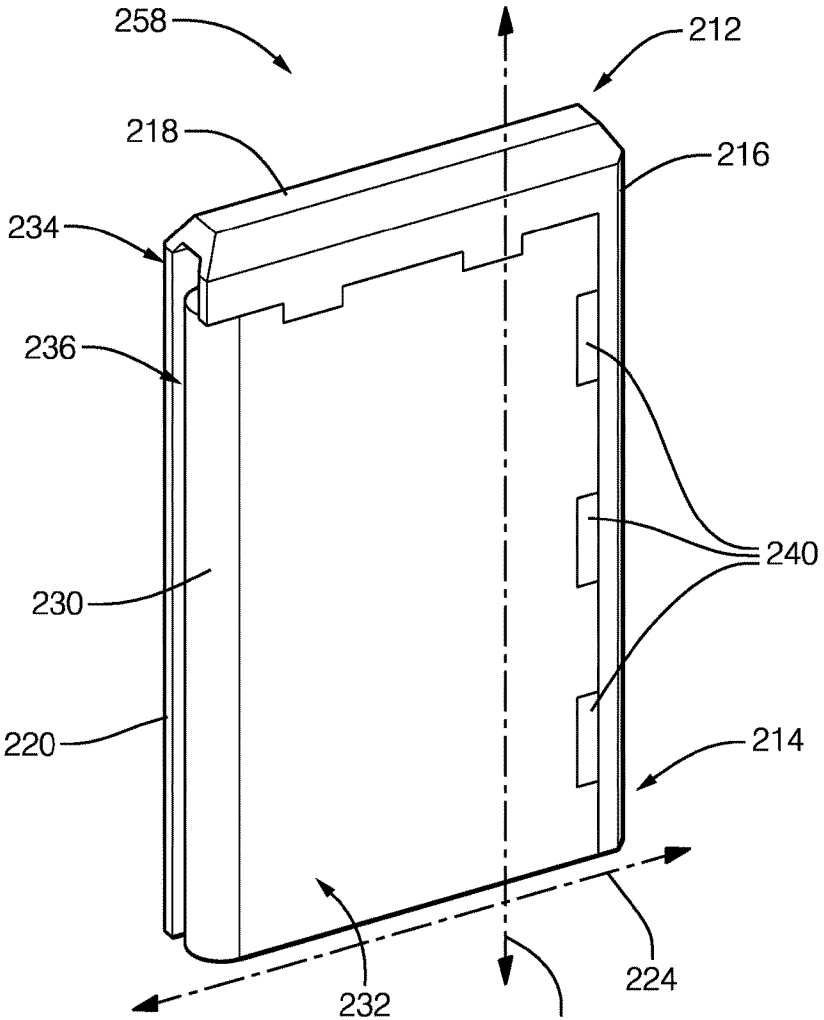
FIG. 11A is a perspective-view of one side of an alternative second-electrical-terminal from the connector of FIG. 4 in accordance with yet another embodiment.

FIGS. 11A-11B illustrate a of yet another example of an alternative second-electrical-terminal 258 that may be included in the electrical connector 48 of FIG. 4. The second-electrical-terminal 258 includes a planar blade-shaped isolator 212 formed of a dielectric material 214. The planar blade-shaped isolator 212 has a spine 216, a tip 218, and a web 220. The spine 216 extends along a longitudinal-axis 222. The tip 218 extends along a lateral-axis 224 normal to the spine 216, and the web 220 (see FIG. 11B) extends in a lateral direction from and normal to a side 286 of the spine 216 along the longitudinal-axis 222 and terminates at the tip 218.

Figure 12:
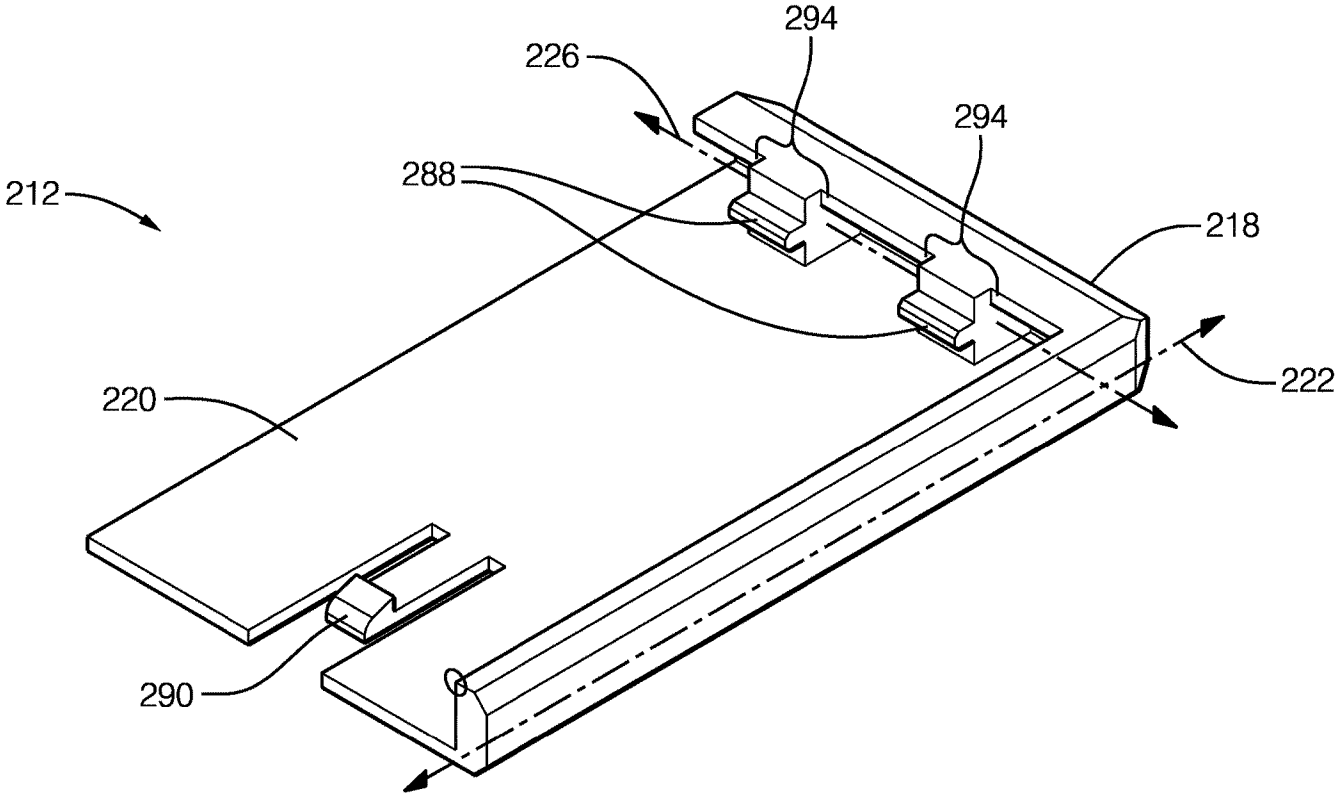
FIG. 12 is a perspective-view of a planar blade-shaped isolator of the alternative second-electrical-terminal of FIGS. 11A-11B in accordance with yet another embodiment.

FIG. 12 illustrates the planar blade-shaped isolator 212 removed from the second-electrical-terminal 258. The tip 218 includes a plurality of locating-tabs 288 extending along the longitudinal-axis 222 from a mid-line 226 of the tip 218 and overlaying the web 220. The plurality of locating-tabs 288 are configured to engage a conductor 230, as will be described in more detail below.

Figure 13A:
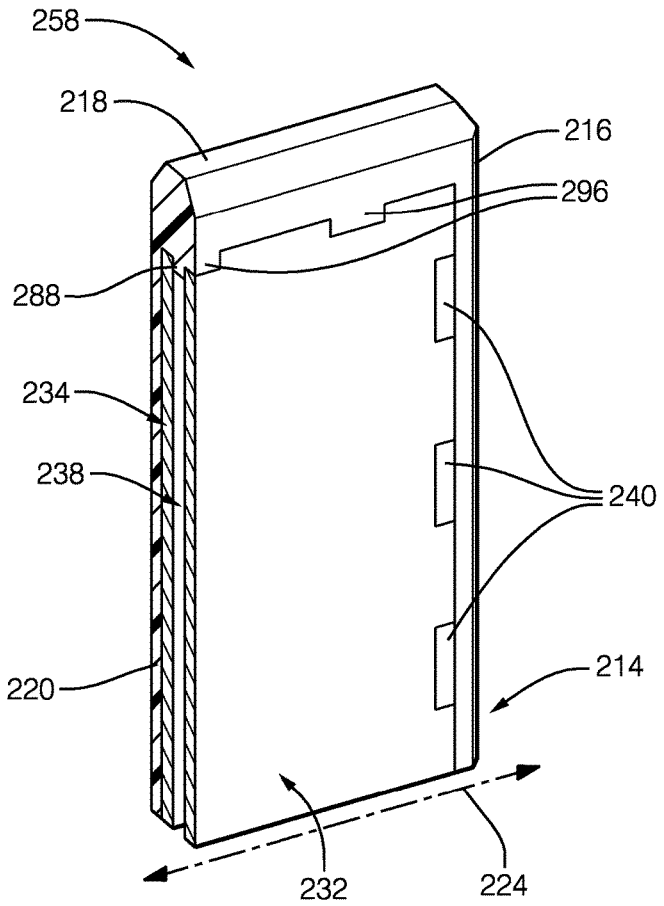
FIG. 13A is a cross-section view of the alternative second-electrical-terminal of FIG. 11A in accordance with yet another embodiment.
Figure 13B:
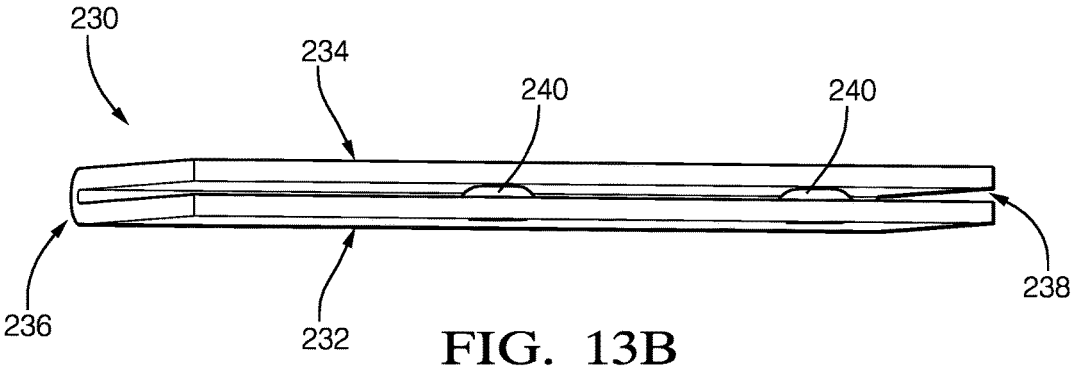
FIG. 13B is a perspective-view of a conductor from the alternative second-electrical-terminal of FIG. 11A in accordance with yet another embodiment.

FIG. 13A illustrates a cross-section view of the second-electrical-terminal 258 of FIG. 11A. The second-electrical-terminal 258 includes the conductor 230 (see FIG. 13B) formed of a single piece of electrically conductive-material. The conductor 230 has a first-side 232 that overlays a second-side 234 and defines a U-shaped bend 236 and a gap 238 between the first-side 232 and the second side 234. The gap 238 is configured to receive the plurality of locating-tabs 288. The U-shaped bend 236 is aligned parallel to and opposite the spine 216 (see FIG. 11A). The conductor 230 includes a conductive stand-off 240 located intermediate the first-side 232 and the second-side 234 of the conductor 230 such that the first-side 232 and the second-side 234 are in further electrical contact through the conductive stand-off 240. The conductive stand-off 240 provides the technical benefit of resisting resist creep (i.e. deformation) of the conductor 230 due to a normal-force exerted by the first-electrical-terminal 54 at elevated operating temperatures characteristic of high current applications. The number and positions of the conductive stand-offs 240 may be determined by the material properties of the conductor 230 and a dimension of the conductor 230. The conductor 230 may include a plurality of conductive stand-offs 240 located intermediate the first-side 232 and the second-side 234. The plurality of conductive stand-offs 240 may be integrally formed (e.g. an embossing process) in the conductor 230 and may be positioned proximate to edges of the conductor 230. The plurality of conductive stand-offs 240 may also be integrally formed in both the first-side 232 and the second-side 234 of the conductor 230. Alternatively, the plurality of conductive stand-offs 240 may have an interlocking-feature 298 that inhibits a movement of the edges of the conductor 230 along the transverse-axis 242 orthogonal to both the longitudinal-axis 222 and the lateral-axis 224 (see FIG. 14).

Referring back to FIG. 11B, the web 220 includes a locking-tab 290 and the conductor 230 defines an aperture 292 wherein the locking-tab 290 is disposed within the aperture 292. The locking-tab 290 provides the technical benefit of inhibiting a movement of the planar blade-shaped isolator 212 along the longitudinal-axis 222.

Figure 14:
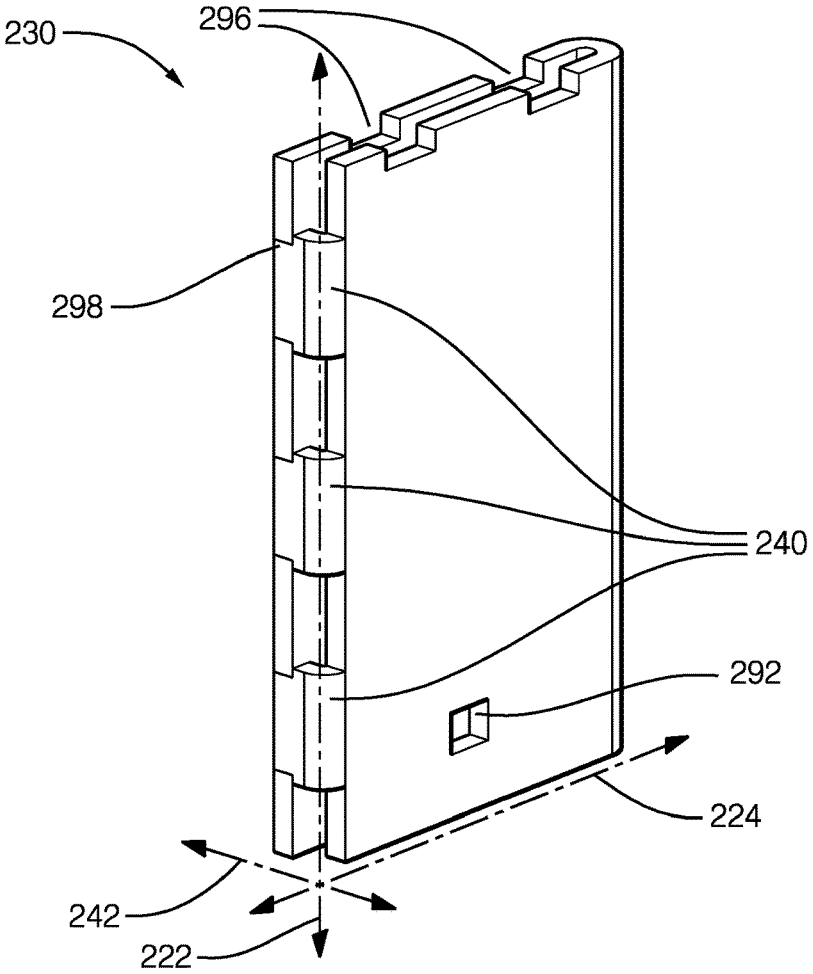
FIG. 14 is a perspective view of the conductor of FIG. 13A illustrating the conductive stand-off with an interlocking-feature in accordance with yet another embodiment.

Referring back to FIG. 12, the plurality of locating-tabs 288 define a plurality of shoulders 294 that extend beyond the tip 218 along the longitudinal-axis 222, and the conductor 230 further defines a plurality of corresponding notches 296 (see FIG. 14). The plurality of shoulders 294 are disposed within the plurality of corresponding notches 296. The plurality of shoulders 294 provide the technical benefit of inhibiting movement of the conductor 230 along the lateral-axis 224, as illustrated in FIG. 13A.

Figure 15:
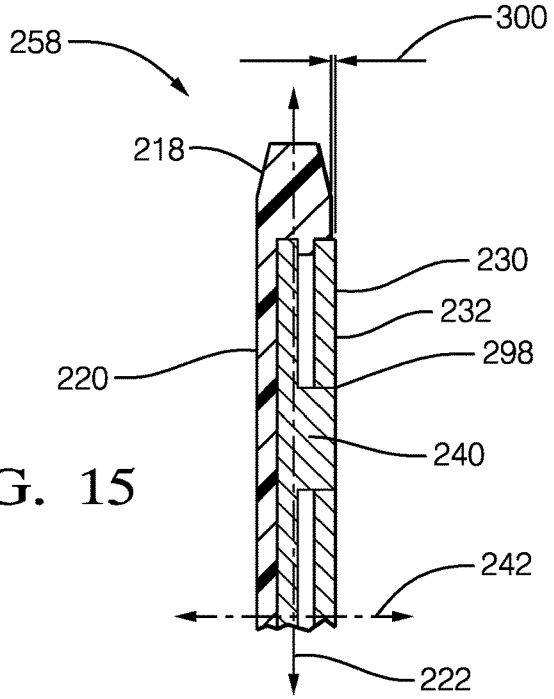
FIG. 15 is a cross-section view of the alternative second-electrical-terminal of FIG. 11A in accordance with yet another embodiment.

FIG. 15 illustrates a cross-section view of the second-electrical-terminal 258 along a transverse-axis 242 that is orthogonal to both the longitudinal-axis 222 and the lateral-axis 224. The first-side 232 of the conductor 230 may lay in relief 300 of, i.e. extends beyond, outer surfaces of both the spine 216 and the tip 218 along the transverse-axis 242. The relief 300 of the first-side 232 relative to the spine 216 and the tip 218 provides the technical benefit of inhibiting the material of the tip 218 from being displaced and forming a non-conductive deposit on the first-side 232 and of the conductor 230 that could potentially reduce the surface conductivity of the second-electrical-terminal 258 when the first-electrical-terminal 54 from the first-housing 50 engages the second-electrical-terminal 258 and slides along the longitudinal-axis 222.

Accordingly, a high-current electrical-terminal 10, 58, 258 is provided. The electrical-terminal 10, 58, 258 provides the technical benefit of increasing the electrical current carrying capacity of the electrical connector 48, while protecting against an electrical shock caused by inadvertent contact of with an energized terminal.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

We claim:

1. An electrical connector, comprising:

a first-housing having a first-electrical-terminal; and a second-housing configured to mate with the first-housing, the second-housing including a protective-shroud and a second-electrical-terminal having a planar blade-shaped isolator formed of a dielectric material and an outer conductor disposed within the protective-shroud, the protective-shroud having a front-side, a back-side aligned parallel to the front-side, a first-wall aligned orthogonal to both the front-side and the back-side, and a second-wall aligned parallel to the first-wall, the front-side defining a first-opening that exposes a leading-edge of the second-electrical-terminal, the back-side including an extension extending outward and aligned perpendicular to the back-side, the extension defining a second-opening that exposes a portion of a trailing-edge of the second-electrical-terminal, the protective-shroud defining a terminal-slot extending from the second-opening to the first-opening and bounded by the first-wall and the second-electrical-terminal, the terminal-slot configured to receive the first-electrical-terminal, wherein when the first-housing is mated with the second-housing the first-electrical-terminal is disposed within the terminal-slot in electrical and physical contact with the second-electrical-terminal and the first-wall and the extension stabilize the first-electrical-terminal.

2. The electrical connector in accordance with claim 1, wherein the extension is configured to inhibit a standard probe configured to simulate a human finger from contacting the trailing-edge of the second-electrical-terminal when the electrical connector is in an un-mated condition.

3. The electrical connector in accordance with claim 1, wherein the planar blade-shaped isolator having a spine, a tip, and a web, the spine extending along a longitudinal-axis, the tip extending along a lateral-axis normal to the spine, the web extending in a lateral direction from and normal to a mid-line of the spine along the longitudinal-axis and terminating at the tip, the web defining a slot extending in the lateral direction from and normal to the spine, the outer conductor formed of a single piece of electrically conductive-material, the conductor having a first-side that overlays a second-side and defining a U-shaped bend and a gap between the first-side and the second-side, wherein the gap is configured to receive the web, the U-shaped bend aligned parallel to and opposite the spine, wherein the outer conductor includes a conductive stand-off located intermediate the first-side and the second-side of the conductor, and wherein the conductive stand-off is disposed within the slot of the web such that the first-side and the second-side are in further electrical contact through the conductive stand-off.

4. The electrical connector in accordance with claim 3, wherein a height of both the first-wall and the second-wall inhibits a standard probe configured to simulate a human finger from contacting a conductive-surface of the second-electrical-terminal.

5. The electrical connector in accordance with claim 3, wherein the web defines a plurality of slots extending in the lateral direction from and normal to the spine, and wherein the conductor includes a plurality of conductive stand-offs located intermediate the first-side and the second-side.

6. The electrical connector in accordance with claim 5, wherein the plurality of conductive stand-offs are integrally formed in the conductor and are positioned proximate to edges of the conductor.

7. The electrical connector in accordance with claim 6, wherein the plurality of conductive stand-offs are integrally formed in both the first-side and the second-side of the conductor.

8. The electrical connector in accordance with claim 3, wherein a width of the conductor along a transverse-axis orthogonal to both the longitudinal-axis and the lateral-axis is greater than the width of the tip of the planar blade-shaped isolator.

* * * * *